US009377170B2

(12) United States Patent
Gebauer

(10) Patent No.: US 9,377,170 B2
(45) Date of Patent: Jun. 28, 2016

(54) MOTOR VEHICLE LIGHTING DEVICE WITH AN OPTICAL FIBER HAVING A COUPLING LENS AND A TRANSPORT AND CONVERSION LENS

(71) Applicant: Automotive Lighting Reutlingen GmbH, Reutlingen (DE)

(72) Inventor: Matthias Gebauer, Reutlingen (DE)

(73) Assignee: AUTOMOTIVE LIGHTING REUTLINGEN GMBH, Reutlingen (DE)

( * ) Notice: Subject to any disclaimer, the term of this patent is extended or adjusted under 35 U.S.C. 154(b) by 0 days.

(21) Appl. No.: 14/313,012

(22) Filed: Jun. 24, 2014

(65) Prior Publication Data

US 2015/0003095 A1 Jan. 1, 2015

(30) Foreign Application Priority Data

Jun. 26, 2013 (DE) ..... 10 2013 212 355

(51) Int. Cl.
*F21V 9/00* (2015.01)
*F21S 8/10* (2006.01)

(52) U.S. Cl.
CPC ..... *F21S 48/225* (2013.01); *F21S 48/2212* (2013.01); *F21S 48/2243* (2013.01); *F21S 48/2262* (2013.01); *F21S 48/236* (2013.01); *F21S 48/24* (2013.01)

(58) Field of Classification Search
CPC . F21S 48/225; F21S 48/2262; F21S 48/2243; F21S 48/2212; F21S 48/236; F21S 48/24
See application file for complete search history.

(56) References Cited

U.S. PATENT DOCUMENTS 5,785,404 A 7/1998 Wiese
5,890,796 A * 4/1999 Marinelli et al. ..... 362/307
2006/0268564 A1 11/2006 Ruiz
2007/0109791 A1 5/2007 Chinniah et al.

(Continued)

FOREIGN PATENT DOCUMENTS

DE 199 25 363 A1 7/2000
DE 10 2006 053 537 B4 12/2010

(Continued)

OTHER PUBLICATIONS

Feb. 25, 2014 Examination Report for DE 10 2013 212 355.8.

(Continued)

*Primary Examiner* — Donald Raleigh
(74) *Attorney, Agent, or Firm* — Howard & Howard Attorneys PLLC

(57) ABSTRACT

A motor vehicle lighting device is proposed, having a light source, and having an optical waveguide, which has a coupling lens, which has at least one reflector, wherein the optical waveguide has first and second planes that are perpendicular to one another, and intersect, and wherein the lines of intersection are each defined by a light beam emitted from the reflector. The device is distinguished in that a transformation by the coupling lens occurs such that an aperture angle of propagation directions of the light beams lying in the second planes is reduced, and the aperture angle of propagation directions lying in the first planes is not altered, or is altered less strongly, and in that the optical waveguide has a transport and transformation lens, wherein the coupling lens and the transport and deflection lens are separate components.

12 Claims, 7 Drawing Sheets

(56) References Cited

U.S. PATENT DOCUMENTS

| | | | | |
|---|---|---|---|---|
| 2010/0208490 | A1* | 8/2010 | Tsuchiya et al. | 362/606 |
| 2012/0075876 | A1 | 3/2012 | Dubosc et al. | |

FOREIGN PATENT DOCUMENTS

| | | | |
|---|---|---|---|
| DE | 10 2010 013 931 | A1 | 10/2011 |
| DE | 10 2011 052 351 | A1 | 2/2012 |
| DE | 10 2010 046 022 | A1 | 3/2012 |
| DE | 10 2011 018 50 | A1 | 10/2012 |
| EP | 2 169 296 | A1 | 3/2010 |
| EP | 2 530 372 | A1 | 12/2012 |

OTHER PUBLICATIONS

Jul. 16, 2015 Examination Report for DE 10 2013 212 355.8.

* cited by examiner

MOTOR VEHICLE LIGHTING DEVICE WITH AN OPTICAL FIBER HAVING A COUPLING LENS AND A TRANSPORT AND CONVERSION LENS

CROSS-REFERENCE TO RELATED APPLICATION

This application is based upon and claims priority to German Patent Application DE 102013212355.8 filed on Jun. 26, 2013.

BACKGROUND OF THE INVENTION

1. Field of Invention

The present invention relates generally to lighting devices for motor vehicles and, more specifically, to a lighting device with an optical fiber having a coupling lens and a transport and conversion lens.

2. Description of Related Art

Motor vehicle lighting devices known in the art typically include a light source and have having an optical waveguide. The optical waveguide has a first side, a second side lying opposite the first side, and narrow sides lying between an edge of the first side and an edge of the second side, and connecting the first side to the second side. The optical waveguide also has a coupling lens that couples and transforms the light from the light source, wherein the coupling lens has at least one reflector which transforms light emitted from the light source in a solid angle. Further, the optical waveguide has imaginary first planes and second planes, which are defined in that the first and second planes are perpendicular to one another, and intersect, wherein the lines of intersection are each defined by a light beam emitted from the reflector. A lighting device of this type is known from Published German Patent Application DE 19925363 A1.

In order to obtain a parallel light diffusion in the optical waveguide in the direction toward the light emission surface, the known lighting device provides that the narrow side of the plate-shaped optical waveguide lying opposite the band-shaped light emission side is designed as a reflector, which has parabolic contours in the first planes, thus in the planes parallel to the extended plate surfaces, and the plane perpendicular thereto has a prismatic contour, which deflects the light striking it twice. As a result, the reflector deflects light striking it at an aperture angle as parallel light onto the band-shaped light emission surface lying opposite the reflector.

A major disadvantage of this optical waveguide is that light emitted radially, directly into the half space facing the light emission surface, does not reach the reflector, and for this reason, is not parallelized. For use in lighting devices for motor vehicles, whether this is for headlamp functions or for signal light functions, however, a light emission surface is desired that is illuminated by light that is parallel and homogenous (uniformly bright) to the greatest extent possible. Light of this type has, for example, the advantage that it can be particularly easily distributed in light distributions conforming to government-mandated regulations with lenses disposed downstream and/or in the light emission surface. From the perspective of the design, moreover, an optical waveguide is desired, having a band-shaped light emission surface with a large ratio for the length of the light emission surface to its width, and which fulfills these requirements regarding homogeneity and parallelity.

Based on this background, the object of the invention is to provide a lighting device having an optical waveguide, which has a band-shaped light emission surface, which is homogenously illuminated by light that is parallel to the greatest extent possible, and which can be produced easily, and in a large number of variations, and can be adapted to various designs for motor vehicle lighting devices, which differ, for example, in terms of the available installation space.

SUMMARY OF THE INVENTION

The present invention overcomes the disadvantages in the prior art in a motor vehicle lighting device having a light source and having an optical waveguide, which has a first side and a second side lying opposite the first side, and narrow sides lying between an edge of the first side and an edge of the second side, and connecting the first side to the second side, and which has a coupling lens that couples and transforms the light from the light source, wherein the coupling lens has at least one reflector, which transforms light emitted from the light source in a solid angle, and wherein the optical waveguide has imaginary first planes and second planes, which are defined in that the first and second planes are perpendicular to one another, and intersect, wherein the lines of intersection are each defined by a light beam emitted from the reflector, characterized in that the transformation by the coupling lens occurs such that an aperture angle of propagation directions of the light beams lying in the second planes is reduced, and the aperture angle of propagation directions lying in the first planes is not altered, or is at least altered less strongly than the aperture angle of the propagation directions lying in the second planes, and in that the optical waveguide has a transport and transformation lens, which transports the light transformed by the coupling lens to a light emission surface of the optical waveguide, wherein the coupling lens and the transport and deflection lens are separate components.

Because the transformation by the coupling lens occurs such that an aperture angle of propagation directions lying in the second planes is reduced, and because the aperture angle of propagation directions lying in the first planes is not altered, or is altered less strongly than the aperture angle of the propagation directions lying in the second plane, the coupling lens can be designed such that it is optimized for the transformation occurring in the second planes. Further transformations of the light bundle, which occur in the first planes, can then occur by structures disposed in the transport and transformation lens.

The transformation of the light bundle emitted from the light source, occurring as a whole until the light emission via the light emission surface of the transport and transformation lens, can thus be allocated to two components. In this way, a disadvantageously high complexity of a component, which executes all transformations, is avoided. Because the first planes and the second planes are oriented such that they are perpendicular to one another, the transformation in the first planes can be altered by structural changes, without altering the transformation in the second planes. Each of the two components can be optimally designed, independently of one another, for the transformation occurring in or on it.

Because the optical waveguide has a transport and transformation lens, which transports light transformed by the coupling lens to a light emission surface of the optical waveguide, wherein the coupling lens and the transport and transformation lens are separate components, it is also possible to manufacture the coupling lens separately from the transport and transformation lens.

Optical waveguides are normally manufactured in injection molding processes. For this reason, it is difficult to produce strongly bowed or bent optical waveguides. By separating the optical waveguide into a coupling lens in the manner of a circular ring, and plate-like transport and transformation lens, for example, two easily shaped and thus readily producible components are obtained, which form a complex optical waveguide when joined.

As a result of the structural separation, numerous combinations can be produced from a few basic shapes. A preferred design is distinguished in that the coupling lens is designed as a ring-shaped component having an edge. This design is suitable for assemblies in which the light is coupled by a broadside in the optical waveguide. This has the advantage that the optical properties react relatively little to bearing tolerances for the light source. A likewise preferred alternative is distinguished in that the coupling lens has the fundamental shape of a straight cylinder with semi-circular end surfaces.

One advantage of this coupling lens is that the light sources can be disposed such that their main beam direction is parallel to the main beam direction of the lighting device. In this way, structural limitations pertaining to the configuration of the light source and the power supply elements allocated thereto, can be circumvented. Preferably, both alternatives have one light decoupling surface having a shape adapted to the shape of the light coupling surface of the transport and transformation lens. In this way, an already existing transport and transformation lens can be combined with different coupling lenses.

The coupling lens, designed as a circular component having an edge, preferably has a first reflector at its center, having the shape of a funnel-shaped recess with a circular base. A funnel-shaped recess is understood here to be a rotationally symmetrical recess, the geometrical shape of which is generated by rotating an edge curve about an axis. The edge curve can be straight or curved. The volume generated by the rotated edge curve should have a point lying on the rotational axis in one design, which is directed toward the light source. In another design, the volume should taper toward the light source, but not end in a point, but rather, it should have a blunt shape, as is the case, for example, with a truncated cone. In a preferred design of this coupling lens, the recess is rotationally symmetrical, and concentric to the circular edge of the coupling lens. In a likewise preferred design of this coupling lens, the lowest point of the recess has the shape of a point, which is directed toward the interior of the coupling lens. It is also preferred that a transport and transformation lens is provided with numerous coupling lenses, in order to homogenously illuminate a complex band-like light emission surface with parallel light. Each of the coupling lenses thereby has a light source allocated to it. It is furthermore preferred that the coupling lens and the transport and transformation lens are made from the same material. The coupling lens and the transport and transformation lens then have the same refraction index, thus reducing losses in the transference of the light beams from the coupling lens to the transport and transformation lens. Preferred materials are polymethyl methacrylate (PMMA) or polycarbonate (PC). In the design of the reflectors, it should be taken into account that the critical angle of the total internal reflection differs for these two materials. It is also preferred that a light emission surface of the coupling lens is congruent to a light entry surface of the transport and transformation lens, and that these surfaces adjoin one another directly, in the direction of the light beams passing through them, such that they are in contact with one another over the entire surface. The term "congruence" means that both surfaces are identical in terms of their surface area. The congruence of the light coupling surface and the light decoupling surface then results in nearly all light passing from the coupling lens, via the light decoupling surface, into the transport and transformation lens, via the light coupling surface, and losses are thus minimized.

It is also preferred that the light decoupling surface of the coupling lens is designed as a cylinder barrel, standing perpendicular to the first planes and perpendicular to the second planes. The aperture angle of the propagation directions lying in the first planes is not altered, or is altered only very little, by the coupling lens. The radial propagation directions of the light in the first planes thus remain intact at the transition into the transport and transformation lens. The aperture angle of the propagation directions lying in the second planes is reduced by the coupling lens. Ideally, the aperture angle is reduced to the extent that the light is aligned such that it is parallel, and strikes the light decoupling surface, designed as a cylinder barrel, at a right angle. The light beams striking at a right angle are not refracted and not reflected. The Fresnel losses as a result of the transition are thus significantly reduced, and amount to ca. 8%. It is moreover preferred that the light decoupling surface of the coupling lens is subdivided into numerous individual surfaces, which are disposed and shaped such that the propagation directions of the light lying in the first planes are altered during the passage through an individual surface as the result of refraction. As a result, the downstream structures of the transport and transformation lens in the beam path, which are to cause a change in direction in the light beams in the first planes, can be designed such that they are less complex. Furthermore, a tooth-like configuration of the individual surfaces, for example, simplifies a radial, form-locking connection of the coupling module to the transport and transformation lens. As an alternative, or in addition thereto, it is preferred that the light decoupling surface is subdivided into numerous individual surfaces, which are disposed in the manner of steps, such that the coupling lens has different cross-sections in the first planes lying transverse to the rotational axis of its recess, from one plane to the next. This design promotes a form-locking fitting of the coupling lens to the transport and transformation lens in the axial direction.

A further design provides that the transport and transformation lens has structures that are suitable and configured for altering the aperture angle of the propagation directions of the light beams lying in the first planes. The structures are, for example, realized as edge surfaces of recesses in the transport and transformation lens and/or as exterior surfaces of the transport and transformation lens. The edge surfaces or exterior surfaces are realized as reflecting surfaces or as refracting surfaces. The light propagation direction is therefore deflected by refraction or reflection, wherein, with respect to reflections, total internal reflections are preferred. It is also conceivable to design the structures as deflection surfaces, on which a total internal reflection occurs such that the aperture angle of the propagation directions lying in the first planes is reduced. Regarded as a whole, the structures serve to produce a homogenous illumination of the light emission surface with light that is parallel to the greatest extent possible.

It is furthermore proposed that the coupling lens, the light sources disposed on a supporting element, and a potential heat sink in thermal contact with the supporting element, are assembled such that they combine to form a coupling module. Exemplary connecting technologies for the coupling module are clips, stamps, rivets or threaded fasteners. The light source, an LED for example, is disposed on the supporting element. Normally, aside from the LED, other components and conductor paths are disposed on the supporting element, which serve as a power supply and as a control for the LED. The supporting element usually is in thermal contact with a heat sink. The heat sink is configured to absorb heat resulting from the operation of the LED and discharge the heat into the environment.

One problem with the use of optical waveguides in lighting devices is that the light source, due to the small focal length of the coupling lens, needs to be positioned very precisely in relation thereto. This can be readily achieved with this module. Light emitted from the coupling module is already parallelized in the second planes. The parallelization in the first planes then occurs with a lens having a greater focal length, by the structures in the transport and transformation lens, for example. This parallelization is relatively unaffected, with respect to bearing tolerances of the light source lying on the broadside, due to the long focal length, which represents an advantage for the coupling occurring via the broadside. Furthermore, it is proposed that the coupling lens has retaining structures, which are suited and configured for retaining the coupling lens on the coupling module. These retaining structures are made of the same material as the coupling lens and are produced, together with the coupling module, by injection molding, in a tool having a relatively simple design. In addition, it is proposed that the coupling lens has positioning elements, which are suitable for positioning the transport and transformation lens on the coupling lens. These positioning elements can be produced during the injection molding of the coupling lens using a tool suitable for this.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
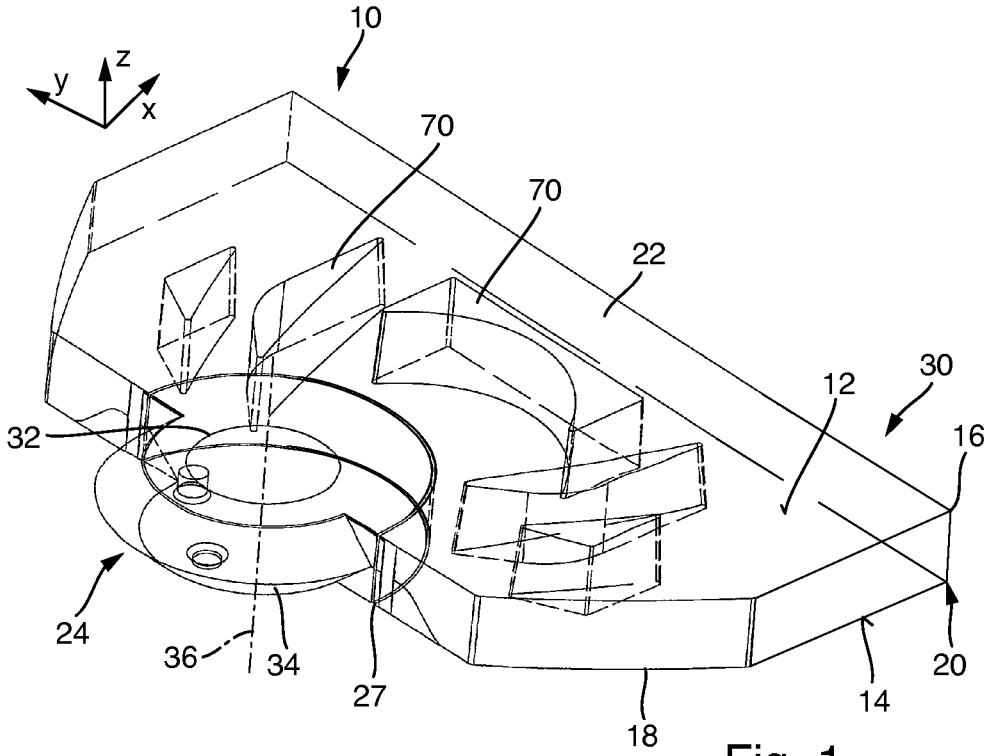
FIG. 1 shows a first embodiment example of a feature of an optical waveguide according to the present invention, in a perspective depiction.

Identical reference symbols in the different figures indicate, respectively, identical elements, or at least elements having comparable functions. FIG. 1 shows an optical waveguide 10 in a perspective view, having a first side 12, a second side 14, lying opposite the first side 12, and narrow sides 20, lying between an edge 16 of the first side 12 and an edge 18 of the second side 14, and connecting the first side 12 to the second side 14. The first side 12 and the second side 14 lie parallel to the xy plane of an imaginary coordinate system here. It is not, however, absolutely necessary for the invention that the first side 12 is parallel to the second side 14. The dimensions of the first side 12 and the second side 14 are large in relation to the width of the narrow side, corresponding to the spacing of the first side 12 from the second side 14. This large ratio characterizes the appearance of the optical waveguide 10 as a plate-shaped component. The ratio is preferably greater than five.

A region of the narrow side 20, normally lying in the x-axis, is designed as the light emission surface 22. In the depicted embodiment example, the expansion of the light emission surface 22 in the y-axis is many times greater than its expansion in the z-axis, where a stripe-shaped form of the light emission surface 22 is obtained. The visible structuring of the light emission surface, in the form of vertical lines, serves to generate a light distribution conforming to regulations. A structuring of this type is an optimal feature, because the light distribution can be generated by an additional lens element, for example, which may be located behind the optical waveguide in the beam path.

The optical waveguide 10 has a coupling lens 24 designed as a separate component. In the design depicted in FIG. 1, the coupling lens 24 is designed as a component having a circular edge. The coupling lens 24 has a light decoupling surface. Both the light decoupling surface as well as the light coupling surface have a semi-cylindrical shape. The semi-cylindrical concave light coupling surface represents, with its concave bowing, basically a negative to the semi-cylindrical convex light decoupling surface of the coupling lens 24 here. The light decoupling surface is thus congruent to a light coupling surface of a transport and transformation lens 30 of the optical waveguide 10. Of the two congruent surfaces, in FIG. 1, only one edge 27, respectively, is shown.

In its center, the coupling lens 24 has a first reflector 32, having the shape of a funnel-shaped recess with a circular base. The recess is rotationally symmetrical and concentric to the circular edge of the coupling lens 24. The lowest point of the recess has the shape of a point 34, directed toward the interior of the component 24. The point 34 lies on a rotational axis of the recess. The edge surface of the funnel-shaped recess serves as a reflector 32, as will be explained in greater detail below. The edge surface of the recess is furthermore preferably shaped such that the light striking it from a light source lying on the rotational axis experiences a total internal reflection there.

Alternatively, or in addition thereto, the reflecting surface of the first reflector 32 is mirror plated, with metal coating applied thereto, for example. This applies analogously to all of the reflecting surfaces specified in this application. It is preferred, however, that these surfaces, to the extent this is allowed by the angular ratios in each case, are designed as total reflecting edge surfaces, because with total internal reflection, less loss occurs than with mirror plated edge surfaces, which is beneficial in attempting to obtain a greater efficiency. It is also advantageous in that no mirror coating has to be applied.

One axis 36 of the coupling lens 24 lies parallel to the z-axis of the coordinate system, and is identical to the rotational axis of the funnel-shaped recess. A light source 38 is disposed on the axis 36 beneath the point 34 of the recess, which is covered in FIG. 1 by the coupling lens 24.

Light is emitted from the light source in a solid angle, in the center of which lies the axis 36. This light strikes, at least in part, the reflector 32, and is reflected there such that the reflected light beams are deflected into first planes, which lie parallel to the xy-planes in FIG. 1. Directional components of the light beams lying radially to the axis 36 remain intact, due to the rotational symmetry of the reflector in relation to the axis 36. The light that has been transformed thereby passes through the light decoupling surface 26, out of the coupling lens 24, and into the transport and transformation lens 30 via the light coupling surface 28 thereof, which directly adjoins the light decoupling surface of the coupling lens 24, and preferably is in contact with this light decoupling surface over the course of its surface.

The transport and deflection lens 30 has structures 70 that are configured to deflect light propagated in the transport and transformation lens 30 such that the light emission surface 22 of the optical waveguide 10 is illuminated from its interior at a uniform brightness with substantially parallel light. A light distribution conforming to government-mandated regulations can be readily generated with this light, which extends, for example, over a horizontal angular breadth of ±20° and a vertical angular breadth of ±10°. A functionality of the structures 70 will be explained in detail later, based on FIG. 4. The transformation of the parallel light into a light distribution conforming to government-mandated regulations occurs, for example, with diffuser lenses in the light emission surface of the optical waveguide.

Figure 2:
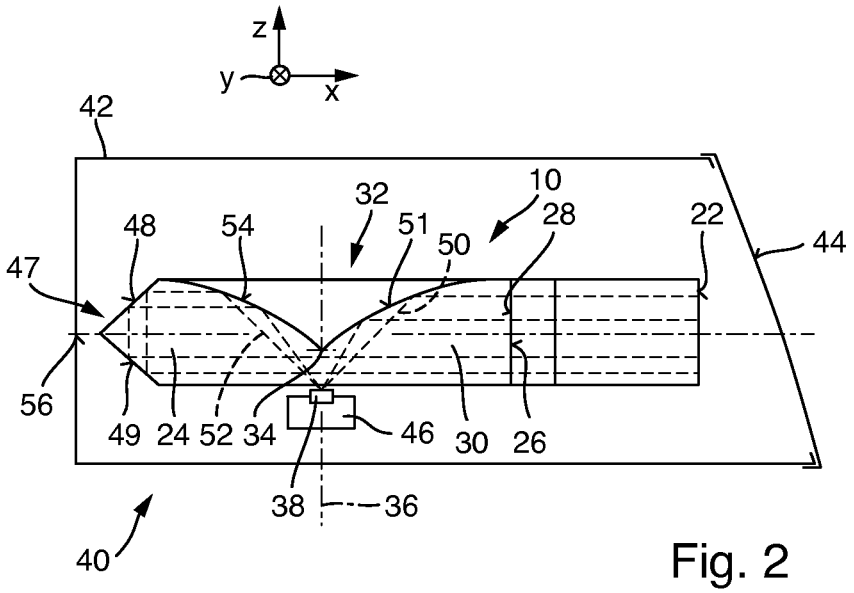
FIG. 2 shows a motor vehicle lighting device, having the optical waveguide from FIG. 1, according to a first embodiment example of the invention, in a cutaway depiction.

FIG. 2 shows an embodiment example of a motor vehicle lighting device 40 according to the invention. The lighting device 40 has a housing 42, the light emission aperture of which is covered with a transparent cover disk 44. The optical waveguide 10 and the light source 38 are disposed in the housing 42. For spatial reasons, the optical waveguide 10 is depicted foreshortened in the direction of the x-axis. The light source 38 is disposed on a supporting element 46 serving as the electrical contact, which in this case also includes a heat sink.

The light source 38 is preferably a semiconductor light source in the form of a Light Emitting Diode (LED). The LED has a flat light emission surface. Semiconductor light sources of this type can be basically regarded as Lambert lights, which emit their light over an angular range of 90° to a norm for the LED light emission surface in a half-space with a solid angle 2Π. A main beam direction of the light source 38 is directed upward in FIG. 2.

The light source 38 thus emits light against the funnel-shaped recess representing the first reflector 32, from below. The recess does not fully penetrate the optical waveguide 10. The depth of the recess, and thus the spacing of its point 34 from the first side 12 is basically one half of the width of the plate, wherein the width of the plate corresponds to the spacing of the first side 12 from the second side 14, measured outside of the recess.

The axis 36 divides the optical waveguide 10 into a front region, which faces toward the light emission surface 22, and lies between the axis and this light emission surface, and a back region, which is bordered by a second reflector 47, and thus lies between the second reflector and the axis 36. The edge surface of the funnel-shaped recess serving as the first reflector 32 preferably has a rotationally symmetrical shape with respect to the rotational axis, which is curved in relation to the radial directions directed away from the rotational axis. As such, the curvature is concave, when seen from the interior of the optical waveguide. With this design, the aperture angle of the light bundle is reduced in the second planes by the reflection on this edge surface.

In one embodiment, the edge surface has a shape that is obtained when a branch of a parabola, the axis of which is perpendicular to axis 36, is rotated about the axis 36. The light source 38 is disposed on this parabola, preferably at the focal point thereof. With this design, a parallel light propagation is obtained in the second planes. Accordingly, the aperture angle of the light bundle is strongly reduced in this respect.

The second reflector 47 is designed as a deflection reflector. The deflection reflector has a first reflector surface 48 and a second reflector surface 49, which are tilted toward one another such that a light beam striking one of the two reflector surfaces is first reflected toward the other reflector surface. The light beam is then deflected again at this other reflector surface, such that its direction is opposite the direction from which the light beam first struck one of the two reflector surfaces.

Because the two reflector surfaces 48 and 49 are tilted toward one another in the manner of a roof, the second reflector 47 is also referred to as a roof-edge reflector. In the first planes, thus in a plane that is perpendicular to the illustration plane in FIG. 2, for example, the second reflector 47 has a semicircular shape, which, seen from the semicircle, is concentric to the circular base surface of the first reflector 32, and is thus coaxial to the axis 36.

Light beams 50, which strike a surface 51 of the first reflector lying in the front region, are reflected thereon, once, toward the light decoupling surface 26 of the coupling lens. Light beams 52 that strike a surface 54 of the reflector 32 lying in the back region, are first deflected thereon toward the second reflector 47.

The sides of the first reflector 32 are concave for the incident light, such that an aperture angle, which contains the propagation directions of the light beams 50 and 52, is reduced. In extreme cases, the reduction of the aperture angle is such that the light beams 50 and 52 originating at the first reflector 32, which lie in a second plane thereof, are parallel to one another, if the sides of the first reflector 32 are parabolic.

The illustration plane of FIG. 2 corresponds to a second plane, as set forth in the definition explained above. Aside from the depicted second plane, numerous other second planes exist. Common to all of the second planes is that they span the axis 36 and a reflected light beam 50 and 52. The reflected light beams 50 and 52 are directed radially away from the axis 36 of the coupling lens 24, or have at least one radial component. Thus, the second planes extend radially toward the axis 36, and for this reason, are referred to as radial planes.

The reflected light beams 50 and 52 define an intersecting line, which is shared by the second plane and the first plane. The first plane is perpendicular to the second plane thereby. In principle, for each of the light beams 50 and 52 reflected by the first reflector 32, there is a pair including a first plane and a second plane perpendicular thereto.

The light beams 50 reflected on the surface 51 lying in the front region exit the coupling lens 24 through the light decoupling surface 26, and enter the transport and deflection lens 30 via the adjoining light coupling surface 28.

A center plane 56 divides the optical waveguide 10 into an upper half 59, in which the majority of the recess lies, and a lower half 60, into which only the point of the recess extends. The lower half 60 is directed toward the light source 38. It thus lies between the light source and the first half, and thus between the light source and the recess. The light beams 52 reflected on the surface 54 lying in the back region strike the first reflector surface 48 of the second reflector 47. The first reflector surface 48 is tilted toward the center plane 56 of the optical waveguide 10 such that light beams 52 arriving there are deflected toward the second reflection surface 49.

The light beams 52 deflected at the first reflector surface 48 are reflected at the second reflector surface 49 toward the light deflection surface 26, and thus toward the transport and deflection lens. Due to the semicircular geometry of the second reflector 47 in the first planes, the second reflector 47 reflects the radial incident light from the first reflector 32 back, in the radial direction opposite to the incident direction. In doing so, the reflected light in the second plane is deflected twice, successively, at a right angle to its respective incident direction. For this, light first propagated in the upper half is deflected to the lower half 60.

Because the first reflector 32 does not fully penetrate the lower half 60, the light is propagated beneath the first reflector 32 through the lower half 60 of the optical waveguide 10 to the light decoupling surface 26, and is not affected by the first reflector thereby. This light exits the coupling lens through the light decoupling surface 26, and enters the transport and deflection lens 30 via the light coupling surface 28 directly adjoining it.

The light in the first planes has the same angular distribution thereby as the light reflected directly from the first reflector, without deflection at the roof-edge reflector toward the transport and deflection lens. The angular distribution can, for this reason, be transformed in the first planes with the same structures. As a result, the same angular distribution is obtained. Because the transport and deflection lens 30 and the coupling lens 24 are preferably made of the same material, and the width of an air gap between them is negligible, no relevant directional changes as a result of refraction occur at the transition of the light from the coupling lens 24 to the transport and deflection lens 30.

Figure 3:
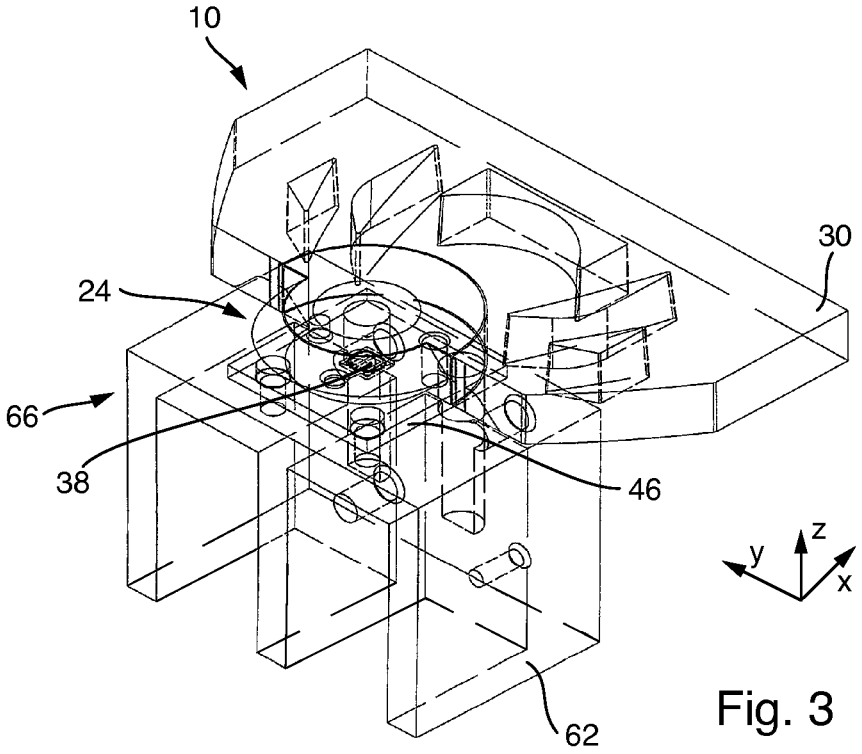
FIG. 3 shows the optical waveguide from FIGS. 1-2, together with a light source, in a perspective depiction.
Figure 4:
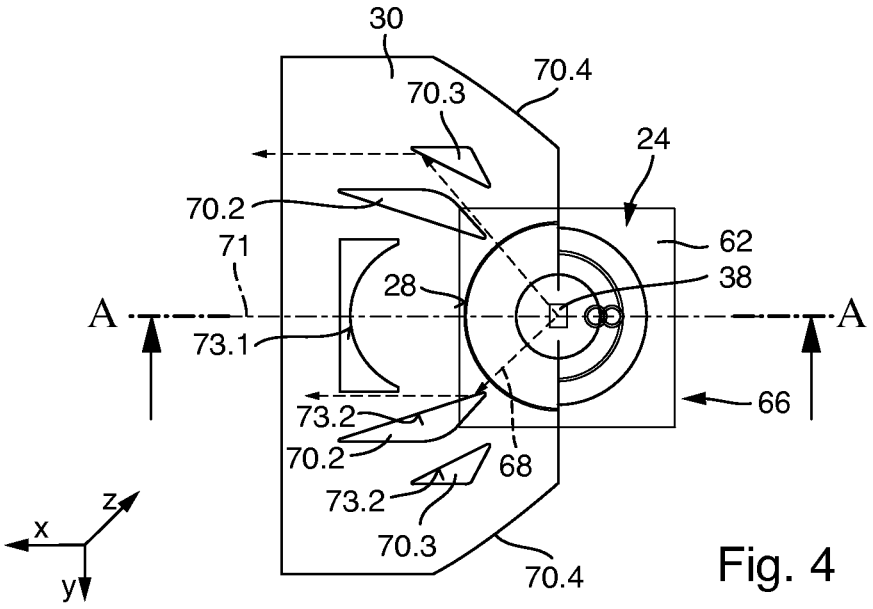
FIG. 4 shows a coupling module and a configuration of the coupling module in an optical waveguide for the first embodiment example, in a top view.

The light decoupling surface 26 and the light coupling surface 28 are designed here to be cylindrical, as can be seen, in particular, in FIGS. 1, 3 and 4. This shape, as well as the preceding parallelization of the light beams 50 and 52 in the second planes, results in all light beams striking the light decoupling surface 26 of the coupling lens at a right angle, and thus also striking the light coupling surface 28 of the transport and deflection lens at a right angle. As a result, the unavoidable Fresnel losses at the transition from the coupling lens 24 to the transport and transformation lens 30 are minimized.

The circular edging of the coupling lens 24, and the concentric configuration thereto of the first reflector, results in the angle between the light beams 48 and 52 first being reduced only in the second planes, while the angular distribution, and thus the directions of the light beams in the first plane, initially remain intact.

The funnel-shaped form of the first reflector 32 and the second reflector 47 designed as a return reflector result in the light beams 48, which exit the light source 38 in the direction of the transport and transformation lens, being propagated above the center plane 56 of the transport and deflection lens 30 in FIG. 2. The light beams 52, which exit the light source 38, travelling in a direction away from the transport and deflection lens 30, experience a double reflection at the return reflector 47. The double reflection results in a reverse in direction and a height displacement of the light beams 52. Thus, the light beams 52 in the figure propagate beneath the center plane 56. In conjunction with a parallel orientation of the light beams in the second planes, there is then the advantage of a uniform illumination of the light emission surface 22 over its extension along the z-axis.

Together, FIG. 1 and FIG. 2 show a lighting device 40 for a motor vehicle, having a light source 38 and having an optical waveguide 10, which has a first side 12, a second side 14 lying opposite the first side 12, and narrow sides 20, lying between an edge 16 of the first side and an edge 18 of the second side 16 [sic: 14], and which connect the first side 12 to the second side 14. A coupling lens 24, coupling and transforming the light from the light source 38, has at least one reflector 32, which transforms light emitted from the light source 38 in a solid angle. The optical waveguide 10 has imaginary first planes and second planes, which are defined in that the are perpendicular to one another, and intersect, wherein the intersections are each defined by light beam 50 or 52 emitted from the reflector 38.

The coupling lens 24 transforms light such that an aperture angle of the propagation directions of the light beams 50 and 52 lying in the second planes is reduced and the aperture angle of propagation directions lying in the first planes are not altered, or at least less strongly altered than the aperture angle of the propagation directions lying in the second planes. The optical waveguide 10 has a transport and transformation lens 30, which transports light transformed by the coupling lens 24 to a light emission surface 22 of the optical waveguide 10. The coupling lens 24, and the transport and deflection lens 30 are separate components.

FIG. 3 shows the optical waveguide 10, which is composed of the coupling lens 24, and the transport and transformation lens 30. The light source 38 is designed as an LED. The LED is disposed on the supporting element 46. Normally, aside from the LED, other components and conductor paths are disposed on the supporting element 46, which serve as a power source and a control for the LED. The supporting element 46 is in thermal contact with a heat sink 62. The heat sink 62 is configured for absorbing heat resulting from the operation of the LED, and conducting this heat into the environment. Retaining structures 64 are formed on the coupling lens 24. The retaining structures 64 are configured for connecting the coupling lens 24, the supporting element 46 with the light source 38, and the heat sink 62, to a coupling module 66.

FIG. 4 shows the coupling module 66 with the transport and transformation lens 30 disposed thereon. Arrows 68 indicate light emission directions in a first plane. The light emission direction is perpendicular to the cylindrical light decoupling surface 26 of the coupling lens 24. The transport and transformation lens 30 has structures that are configured and disposed for deflecting light, which enters the transport and transformation lens 30 at a right angle to the cylindrical light coupling surface 28, onto the light emission surface of the optical waveguide, such that this light emission surface is illuminated as homogenously as possible by light that is as parallel as possible. The structures 70 of the transport and transformation lens 30 according to FIG. 4 are designed as edge surfaces for recesses lying in the optical waveguide, and/or as outer surfaces, which are sub-surfaces of the narrow sides of the transport and deflection lens 30 of the optical waveguide 10.

The structures 70 are disposed symmetrically to a second plane 71, which divides the optical waveguide into two preferably symmetrical halves. The second plane 71 is perpendicular to the first planes and contains the axis 36 of the coupling lens 24. A centrally disposed recess 7.1 is designed as a concave-planar lens made of air. The concave-planar air lens reduces the aperture angle of the incident light bundle, and thus contributes to a parallelization of the light in the first planes. Edge surfaces 73.2 and 73.3 of lateral recesses 70.2, 70.3, as well as an outer surface 73.4, are designed as parabolic sections.

A slope of the parabolas increases thereby, regarded from one parabolic section to the next parabolic section, from outside toward the interior in the direction of the second plane 71. The parabolic sections lying furthest outward in the optical waveguide 10 according to FIG. 4*b*, which are formed by the outer surfaces 73.4, have a lesser slope than the parabolic sections lying further inward, which are obtained by the surfaces 73.2 and 73.3 of the recesses 70.2 and 70.3. This is precisely the reverse of the change in slope for a continuous parabola. In that case, the sections having a lesser slope are on the inside, and the sections having greater slopes lie on the outside.

A continuous parabola generates a light distribution from light, which is emitted from its focal point, that is brighter in the middle than at the edges. A light distribution of this type is therefore not homogenous with respect to brightness. This lack of homogeneity is reduced in the subject matter of FIG. 4*b* in that parabolic sections with a comparably lesser slope, which generate the comparably greater brightness in a continuous parabola, are disposed further outward, while parabolic sections having a comparably greater slope, which generate the comparably lesser brightness in a continuous parabola, are disposed further inward. As a result, an overall homogenization of the brightness of the light emitted from the parabolic sections is obtained. The individual parabolic sections are not portions of a single parabola thereby. Rather, although they have the same focal point, they are defined in that they each have different focal lengths. The focal point lies on the optical axis 36 of the coupling lens 24. The focal length of the parabolic sections lying further outward is greater than the focal length of the parabolic sections lying further inward.

The light beams 68, which enter the transport and deflection lens radially through the light coupling surface 28, are deflected at the surfaces 73 by refraction or reflection. The shape of the surfaces 73 causes the deflection to occur such that an aperture angle of the propagating direction of the light in the first planes, i.e. in the illustration plane, for example, is reduced. As a result, the structures 70 also serve to parallelize the light beams that propagate radially in a first plane. Moreover, they serve, as explained above, to homogenize the brightness of the light emitted through the light emission surface 22. Thus, they fulfill two functions.

The coupling module 66 can be combined with different transport and transformation lenses as a preinstalled component, in order to obtain a desired light distribution conforming to government-mandated regulations. A coupling module 66 that has numerous light sources 38 and numerous coupling lenses 24, allocated to the respective light sources 38, is also conceivable. The light sources 38 can be disposed on a shared heat sink 62 thereby. In the scope of a further design, two LEDs with different lighting colors, such as red and yellow, or white and yellow, are located beneath the coupling, such that, depending on which LED is activated, different lighting functions, such as tail-lights (red), blinkers (yellow) or daytime running lights (white) are realized.

Figure 5:
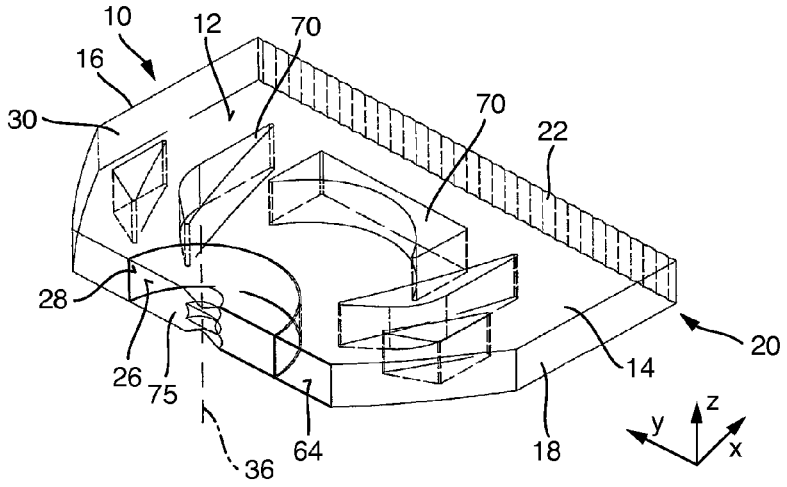
FIG. 5 shows a second embodiment example of an optical waveguide according to the present invention, in a perspective depiction.

FIG. 5 shows a second design for the optical waveguide 10. This optical waveguide 10 differs from the optical waveguide 10 described so far in that it has a different design for the coupling lens. This coupling lens 75 has the basic form of a straight cylinder, with a semi-circular base surface. The coupling lens 75 has a light decoupling surface 26, which is congruent to a light coupling surface 28 of a transport and deflection lens 30. The light coupling surface 28 directly adjoins the light decoupling surface, such that it makes surface contact therewith.

Figure 6:
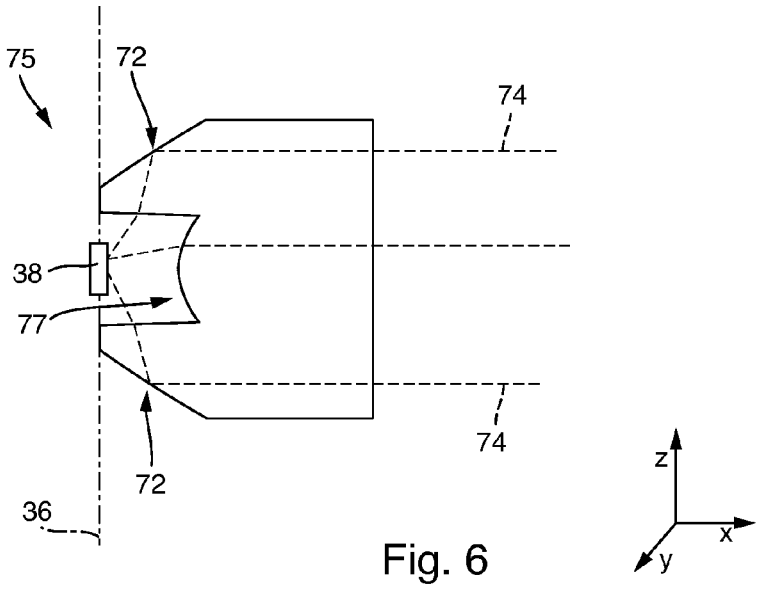
FIG. 6 shows a coupling lens for the optical waveguide from FIG. 5, together with a light source and beam paths, in a cross-section lying in a second plane.

FIG. 6 shows a cutaway depiction of the coupling lens 75 from FIG. 5, having a cutting plane parallel to the xz-plane. This plane is a second plane in the sense of the definition given above. In differing from the optical waveguides described above, the light source 38 is disposed on the axis 36 such that its main beam direction is not parallel, but rather, perpendicular to the axis 36.

The light emitted from the light source 38 in a solid angle encompassing the main beam direction strikes a light entry surface of the coupling lens 75. This light entry surface has a central region and lateral inner surface encompassing the central region. The lateral inner surface is designed such that the light entering through it is deflected as a result of refraction at a first reflector 72. The first reflector 72 is formed here by outer surfaces of the coupling lens 75. The first reflector 72 transforms the light bundle 74 emitted from the light source 38 in a solid angle by total internal reflection.

The central region 77 of the light entry surface is convex, such that a lens effect is obtained. The central region 77 is thus designed, in particular, such that light 79 entering through it is transformed by refraction. The transformation by total internal reflection at the first reflector 72 and the refractive transformation by the central region 77 occur thereby such that an aperture angle of propagation directions of the light beams lying in the second planes is reduced. A second plane is identical to the illustration plane in FIG. 6, by way of example. The semi-circular shape of the coupling lens 75 results in the aperture angle of the propagation directions in the first planes, which are perpendicular to the second planes and their line of intersection with the second planes is defined by light beams 74 emitted from the reflector 72, not being altered, or at least being altered to a lesser degree than the aperture angle for the propagation directions lying in the second planes. This second design allows for a configuration of the light source 38, such that its main beam direction lies at a right angle to the axis 36. As a result, the optical waveguide 10 can also be used in lighting devices 40, which, for structural reasons, do not allow for a main beam direction of the light source 38 that is perpendicular to the light emission direction of the optical waveguide 10.

FIGS. 5 and 6 also show an optical waveguide 10 for a motor vehicle lighting device having a light source 38, which has a first side 12, a second side 14 lying opposite the first side 12, and narrow sides 20 lying between an edge 16 of the first side 12 and an edge 18 of the second side 14, and connecting the first side 12 to the second side 14, and a coupling lens 75 that couples and transforms a light from the light source 38, wherein the coupling lens 74 has at least one reflector 72, which transforms light emitted by the light source 38 in a solid angle, and the optical waveguide has imaginary first planes and second planes, which are defined in that they are perpendicular to one another, and intersect, wherein the lines of intersection are defined, respectively, by a light beam 74 emitted from the reflector 72. The transformation occurs by the coupling lens 75, such that an aperture angle of propagation directions of the light beams 74 lying in the second planes is reduced, and the aperture angle of propagation directions lying in the first planes is not altered, or is altered less strongly than the aperture angle of the propagation directions lying in the second planes. The optical waveguide 10 has a transport and transformation lens 30, which transports the light transformed by the coupling lens 75 to a light emission surface 22 of the optical waveguide 10, wherein the coupling lens 75 and the transport and transformation lens 30 are separate components.

Figure 7:
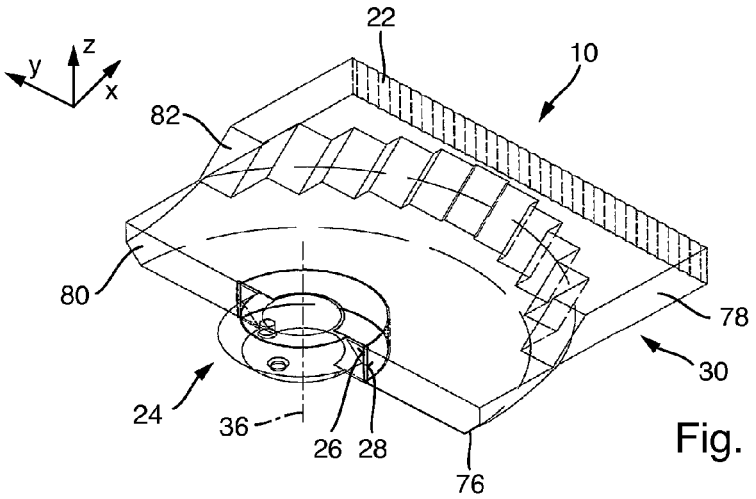
FIG. 7 shows a first design for a transport and transformation lens, with the coupling lens from FIGS. 1-4, in a perspective depiction.

FIG. 7 shows another design for the optical waveguide 10, which differs from the optical waveguides explained above by a different design for the transport and deflection lens 30. A coupling lens 24 is disposed, incorporated in a transport and transformation lens 30, such that the light decoupling surface 26 of the coupling lens 24 directly adjoins the light coupling surface 28 of the transport and transformation lens 30. The transport and transformation lens 30 has a first sub-plate 76, which is adjoined by a second sub-plate 78 offset thereto in the manner of a step. The first sub-plate 76 has a deflection surface 80, concentric to the axis 36, on its narrow side lying opposite the light coupling surface 26. The deflection surface 80 is tilted against the axis 36 such that light striking it from radial directions is deflected upward, in directions lying parallel to the z-axis. The deflection surface preferably has the shape of a section of a conical surface.

A narrow side of the second sub-plate 78 facing the coupling lens 24 is subdivided into numerous facet-like deflection surfaces 82. A configuration of the deflection surfaces 82 in a semi-circle lying above the deflection surface (which has the same radius as the deflection surface) results in the facet-like deflection surfaces 82 being illuminated by light emitted from the concentric deflection surface 80. The deflection surfaces 82 are disposed and designed such that they direct the light striking it toward the light emission surface 22 of the transport and deflection lens 30. The facet-like deflection surfaces 82 reduce the aperture angle of the propagation directions in the first planes, such that the light emission surface is illuminated homogeneously with parallel oriented light here as well from the interior of the optical waveguide. As a result, it is possible to generate a light distribution conforming to government-mandated regulations in a simple manner. This occurs, for example, using diffusing lenses integrated in the light emission surface.

Thus, the deflection surface 80 and the facet-like deflection surfaces 82 depict structures 70, suited for altering the aperture angle of propagation directions of the light lying in first planes, preferably to reduce these, such that a parallelization of the propagation directions in the first planes is obtained.

Figure 8:
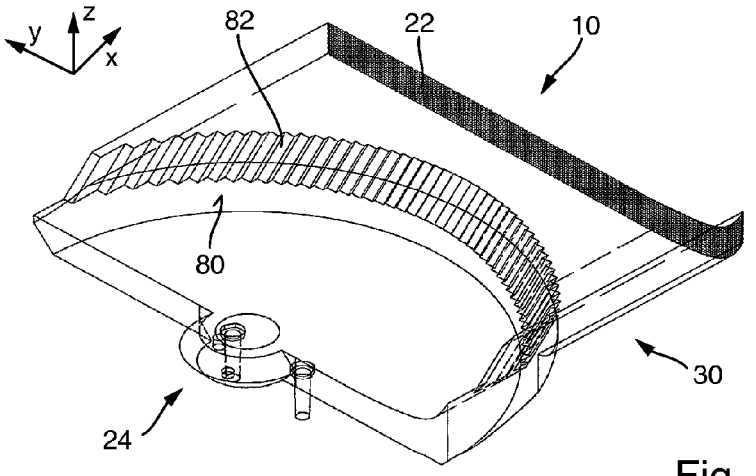
FIG. 8 shows a second design for the transport and transformation lens, with the coupling lens from FIGS. 1-4, in a perspective depiction.

With the design for the optical waveguide 10 depicted in FIG. 8, the transport and transformation lens 30 has a first sub-plate 76 and a second sub-plate 78. The first sub-plate 76 has a deflection surface 80, which preferably has the shape of a section of a conical surface. The second sub-plate 78 has numerous facet-like deflection surfaces 82. The preferably conical surface-shaped deflection surface 80 and the facet-like deflection surfaces 82 combine to form structures 70, which are identical, with respect to their light bundle forming effect, to the structures 70 explained above in reference to FIG. 7. In contrast to the preceding design for the transport and deflection lens 30, the light emission surface 22 in this case is curved. The curvature of the light emission surface 22 occurs about the x-axis, or the z-axis, in order to follow an outer contour of a motor vehicle body in an aerodynamic manner.

The light emitted from the coupling lens 24, and propagated in parallel in the second planes and radially in the first planes, first strikes the concentric deflection surface 80. This deflects the light striking it upward in the depicted design, in the direction of the z-axis. The deflected light strikes the facet-like deflection surfaces 82 and is deflected by these toward the light emission surface 22. The concentric configuration of the deflection surfaces 80 and 82 results in the light in the first planes becoming parallelized. Because the deflection surfaces 80 and 82 follow the curvature of the light emission surface 22, curved light emission surfaces 22 are homogeneously illuminated with substantially parallel light.

Figure 9:
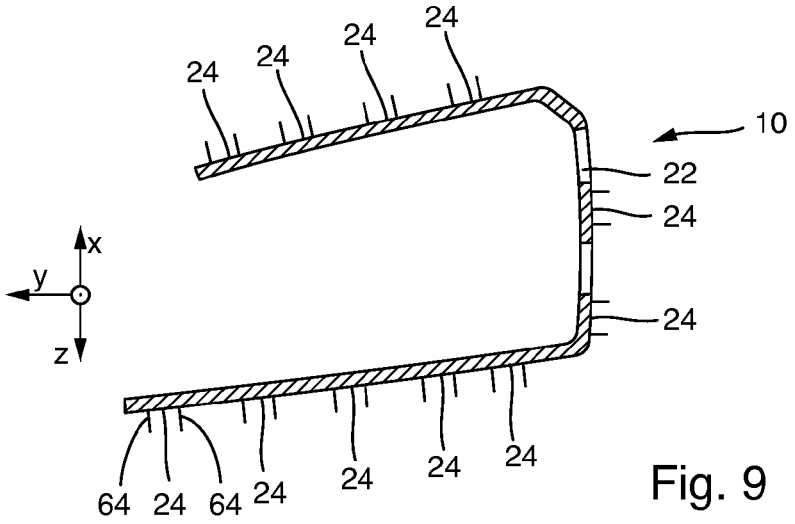
FIG. 9 shows a view of a third design for the transport and transformation lens, with a plurality of coupling lenses from FIGS. 1-4, from a perspective looking toward the light emission surface.

FIG. 9 shows a design for the optical waveguide 10, the light emission surface 22 of which is u-shaped. The optical waveguide 10 has numerous coupling lenses 24. As a matter of course, each of the coupling lenses 24 has a light source 38 allocated to it. The optical waveguide 10 has retaining structures 64, which are suitable and configured for retaining the optical waveguide 10 in the housing. The coupling lenses 24 are distributed along the light emission surface 22 on the back side of the optical waveguide, such that a uniform, homogenous illumination of the complex band-like light emission surface 22 with substantially parallel light is ensured.

The U-shaped design of the light emission surface is generated by stringing together numerous light emission surfaces. In general, a light emission surface of this type can be realized as a single-piece construction, or as a construction having numerous components, wherein in both cases, numerous coupling modules for coupling light can be used. The view depicted in the figure is that of an observer located in the beam direction at a spacing to the light emission surface, and who is looking at the light emission surface. The optical waveguide has numerous coupling lenses. One can envision the optical waveguide as primary optical waveguide configurations disposed adjacent to one another, wherein some of these optical waveguide configurations are curved, in order to obtain the necessary arcs. Each of the coupling lenses has a light source allocated to it. The optical waveguide has retaining structures, which are configured and disposed for retaining the optical waveguide in the housing. The coupling lenses are distributed along the light emission surface of the optical waveguide, such that a uniform, homogenous illumination of the complex band-like light emission surface with substantially parallel light is ensured. It is to be understood that in this way, other elongated and curved shapes can also be realized.

Figure 10A:
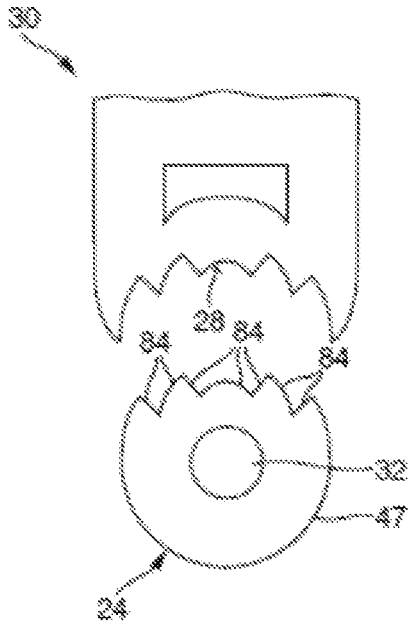
FIGS. 10A-10B show further designs for the coupling lens which differ in the design for a light decoupling surface.

FIG. 10A shows a design for the coupling lens 24 in a top view. The light decoupling surface of the coupling lens is subdivided here into numerous individual surfaces, which are disposed and shaped such that the propagation directions of the light lying in the first planes are altered when passing through an individual surface, as the result of refraction. As a result, it is possible for an aperture angle of the propagation directions of the light lying in the first planes to be already altered in a targeted manner at the transition of the coupling lens 24 to the transport and deflection lens 30. The transport and transformation lens 30 is designed in a less complex manner; in particular, the structures 70 can potentially be omitted.

Figure 10B:
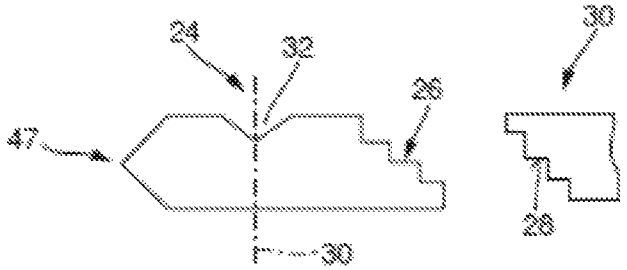

FIG. 10B shows another design for the coupling lens 24 in a cutaway depiction, cut parallel to the xy-plane. In the depicted design, the light decoupling surface of the coupling lens is subdivided into numerous individual surfaces, which are disposed and shaped such that the propagation directions of the light lying in the first planes are altered upon passing through an individual surface, as the result of refraction. The individual surfaces 84 are disposed above one another thereby, in the manner of steps. The step-like configuration of the individual surfaces enables a form-locking fitting of the coupling lens 24, in the direction of the x-axis and in the direction of the z-axis, in the transport and deflection lens 30. Structures, e.g. tooth-like elements, can be disposed on the coupling lens, on the surface 26, to which complementary structures are disposed in the surface 28 of the transport and deflection lens 30, which ensure a precise centering and positioning of the coupling lens and the transport and transformation lens in relation to one another.

Figure 11:
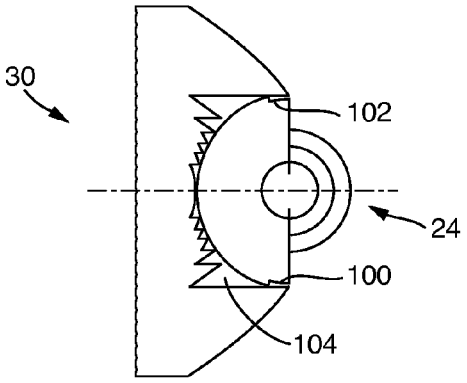
FIG. 11 shows a top view of an assembly having a stepped coupling lens.

FIG. 11 shows a top view of a configuration having a stepped coupling lens. This concerns a design having only two steps 109, 102. The transport and decoupling lens 30, also visible in FIG. 11, has a central air lens, which is realized as a Fresnel lens 104.

Figure 12:
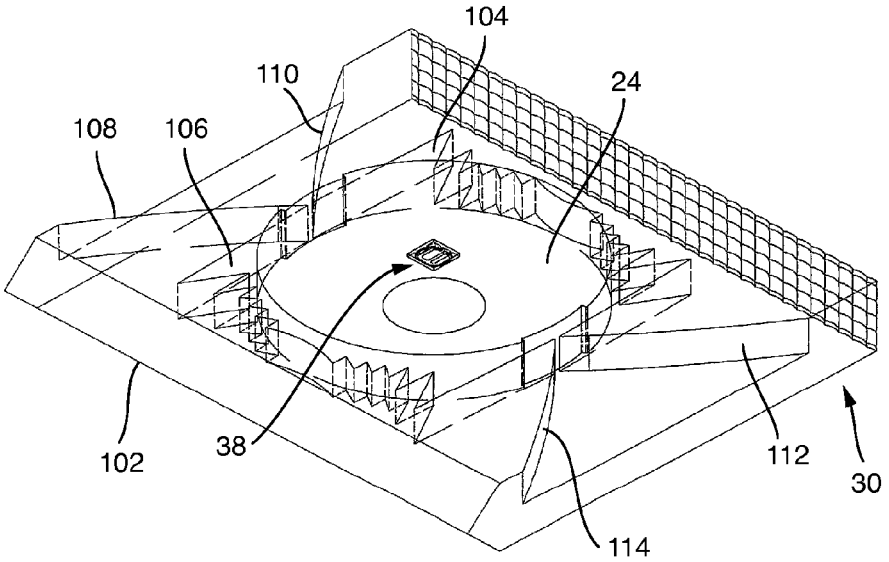
FIG. 12 shows a design having a rotationally symmetrical coupling lens, with 360° emission, and an alternative transport and transformation lens.

FIG. 12 shows a design having a rotationally symmetrical coupling lens 24, with 360° emission, and an alternative transport and deflection lens 30, having two central stepped air lenses 104, 106 in the inner region, in the form of Fresnel lenses, and TIR reflectors 108, 110, 112, 114 (TIR: Total Internal Reflection) in the outer region. The transport and deflection lens has a 180° deflection edge 107 on one side. Structures are disposed on the opposite, light emitting side. The transport and deflection lens can also be realized with multiple components, for example, where one component contains the light emission surface, and one component contains the edge deflecting over 180°.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A motor vehicle lighting device having a light source and having an optical waveguide, which has a first side and a second side lying opposite the first side, and narrow sides lying between an edge of the first side and an edge of the second side, and connecting the first side to the second side, and which has a coupling lens that couples and transforms the light from the light source, wherein the coupling lens has at least one reflector, which transforms light emitted from the light source into a solid angle, and wherein the optical waveguide has imaginary first planes and second planes, which are defined in that the first and second planes are perpendicular to one another, and intersect, wherein the lines of intersection are each defined by a light beam emitted from the reflector, wherein the transformation by the coupling lens occurs such that an aperture angle of propagation directions of the light beams lying in the second planes is reduced, and the aperture angle of propagation directions lying in the first planes is altered less strongly than the aperture angle of the propagation directions lying in the second planes, and wherein the optical waveguide has a transport and deflection lens, which transports the light transformed by the coupling lens to a light emission surface of the optical waveguide, wherein the coupling lens and the transport and deflection lens are separate components, wherein the coupling lens is designed as a circular-edged component having a convex light decoupling surface that is congruent to a concave light coupling surface of the transport and deflection lens, and these surfaces adjoin one another directly, in the direction of the light beams passing through them and wherein the coupling lens has a first reflector at its center, which has the form of a funnel-shaped recess having a circular base surface.

2. The lighting device as set forth in claim 1, wherein the coupling lens and the transport and deflection lens are made of the same material.

3. The lighting device as set forth in claim 1, wherein the coupling lens has the form of a straight cylinder having a semi-circular base surface.

4. The lighting device as set forth in claim 1, wherein the recess is rotationally symmetrical and concentric to the circular edge of the coupling lens.

5. The lighting device as set forth in claim 1, wherein the lowest point in the recess has the form of a point directed toward the interior of the coupling lens.

6. The lighting device as set forth in claim 1, wherein the light decoupling surface of the coupling lens is designed as a cylindrical outer surface wherein the cylinder defines a longitudinal axis that is perpendicular to the first planes.

7. The lighting device as set forth in claim 1, wherein the light decoupling surface is subdivided into a plurality of individual surfaces disposed as steps, such that the coupling lens has different cross-sections in first planes lying transverse to the rotational axis of its recess, from one plane to the next.

8. The lighting device as set forth in claim 1, wherein the transport and deflection lens has structures adapted to alter the aperture angle of the propagation directions of the light beams lying in the first planes.

9. The lighting device as set forth in claim 1, wherein the coupling lens, the light source disposed on a supporting element, and a heat sink in thermal contact with the supporting element are assembled to form a coupling module.

10. The lighting device as set forth in claim 9, wherein the coupling lens has retaining structures adapted to retain the coupling lens on the coupling module.

11. The lighting device as set forth in claim 1, wherein the coupling lens has positioning elements adapted to position the transport and deflection lens on the coupling lens.

12. A motor vehicle lighting device having a light source and having an optical waveguide, which has a first side and a second side lying opposite the first side, and narrow sides lying between an edge of the first side and an edge of the second side, and connecting the first side to the second side, and which has a coupling lens that couples and transforms the light from the light source, wherein the coupling lens has at least one reflector, which transforms light emitted from the light source into a solid angle, and wherein the optical waveguide has imaginary first planes and second planes, which are defined in that the first and second planes are perpendicular to one another, and intersect, wherein the lines of intersection are each defined by a light beam emitted from the reflector, wherein the transformation by the coupling lens occurs such that an aperture angle of propagation directions of the light beams lying in the second planes is reduced, and the aperture angle of propagation directions lying in the first planes is not altered, and wherein the optical waveguide has a transport and deflection lens, which transports the light transformed by the coupling lens to a light emission surface of the optical waveguide, wherein the coupling lens and the transport and deflection lens are separate components, wherein the coupling lens is designed as a circular-edged component having a convex light decoupling surface that is congruent to a concave light coupling surface of the transport and deflection lens, and these surfaces adjoin one another directly, in the direction of the light beams passing through them and wherein the coupling lens has a first reflector at its center, which has the form of a funnel-shaped recess having a circular base surface.

* * * * *